US011817249B2

(12) United States Patent
Miyoshi et al.

(10) Patent No.: US 11,817,249 B2
(45) Date of Patent: Nov. 14, 2023

(54) INDUCTOR COMPONENT

(71) Applicant: Murata Manufacturing Co., Ltd., Kyoto-fu (JP)

(72) Inventors: Hiromi Miyoshi, Nagaokakyo (JP); Kenta Kondo, Nagaokakyo (JP); Yasunari Nakashima, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 542 days.

(21) Appl. No.: 16/206,911

(22) Filed: Nov. 30, 2018

(65) Prior Publication Data

US 2019/0198225 A1 Jun. 27, 2019

(30) Foreign Application Priority Data

Dec. 21, 2017 (JP) ..... 2017-245301

(51) Int. Cl.

| | |
|---|---|
| ***H01F 27/28*** | (2006.01) |
| ***H01F 27/29*** | (2006.01) |
| ***H01F 17/00*** | (2006.01) |
| ***H01F 41/04*** | (2006.01) |

(52) U.S. Cl.

CPC ..... *H01F 27/2804* (2013.01); *H01F 17/0013* (2013.01); *H01F 27/292* (2013.01); *H01F 41/043* (2013.01); *H01F 2027/2809* (2013.01)

(58) Field of Classification Search

CPC ..... H01F 27/2804; H01F 17/0013; H01F 27/292; H01F 41/043; H01F 2027/2809

See application file for complete search history.

(56) References Cited

U.S. PATENT DOCUMENTS

| | | | | |
|---|---|---|---|---|
| 2002/0167389 | A1* | 11/2002 | Uchikoba | H01F 27/027 336/200 |
| 2004/0175569 | A1* | 9/2004 | Uchida | B22F 1/02 428/403 |
| 2013/0187744 | A1 | 7/2013 | Seko et al. | |
| 2017/0110236 | A1* | 4/2017 | Jang | H01F 41/10 |
| 2018/0012697 | A1* | 1/2018 | Jung | H01F 17/0013 |
| 2018/0012700 | A1* | 1/2018 | Lee | H01F 27/323 |
| 2018/0122555 | A1* | 5/2018 | Kim | H01F 27/2804 |
| 2019/0043655 | A1* | 2/2019 | Kato | H01F 27/292 |

(Continued)

FOREIGN PATENT DOCUMENTS

| | | |
|---|---|---|
| JP | 2004-055759 A | 2/2004 |
| JP | 2004-263255 A | 9/2004 |
| JP | 2013-153009 A | 8/2013 |

(Continued)

OTHER PUBLICATIONS

An Office Action; "Notification of Reasons for Refusal," issued by the Japanese Patent Office dated Jan. 28, 2020, which corresponds to Japanese Patent Application No. 2017-245301 and is related to U.S. Appl. No. 16/206,911; with English language translation.

*Primary Examiner* — Marlon T Fletcher
*Assistant Examiner* — Malcolm Barnes
(74) *Attorney, Agent, or Firm* — Studebaker & Brackett PC

(57) ABSTRACT

An inductor component includes an element body including insulating layers laminated on one another, and a coil conductor layer winding on a main surface of one of the insulating layers. The coil conductor layer contains sulfur.

20 Claims, 4 Drawing Sheets

(56) References Cited

U.S. PATENT DOCUMENTS

| | | | | |
|---|---|---|---|---|
| 2019/0066905 | A1* | 2/2019 | Hong | H01F 17/0013 |
| 2019/0156987 | A1* | 5/2019 | Jung | H01F 27/2804 |

FOREIGN PATENT DOCUMENTS

| | | | | |
|---|---|---|---|---|
| JP | 5821535 | B2 | | 11/2015 |
| JP | 2016-115448 | A | | 6/2016 |
| JP | 2016115448 | A | * | 6/2016 |

* cited by examiner

INDUCTOR COMPONENT

CROSS-REFERENCE TO RELATED APPLICATION

This application claims benefit of priority to Japanese Patent Application No. 2017-245301, filed Dec. 21, 2017, the entire content of which is incorporated herein by reference.

BACKGROUND

Technical Field

The present disclosure relates to an inductor component.

Background Art

Hitherto, electronic components are mounted in various electronic devices. One of the electronic components is a multilayer inductor component as described, for example, in Japanese Patent No. 5821535. A multilayer inductor component includes an element body including laminated multiple insulating layers and coil conductor layers winding on the main surfaces of the insulating layers.

SUMMARY

In the production of the above-described inductor component, internal defects such as delamination, cracking and so on between the insulating layer and the coil conductor layer may occur. This may result in a low yield rate.

Accordingly, the present disclosure provides and inductor component to reduce internal defects.

An inductor component according to a one aspect of the present disclosure includes an element body including a plurality of insulating layers laminated on one another, and a coil conductor layer winding on a main surface of one of the plurality of insulating layers. The coil conductor layer contains sulfur. This configuration reduces internal defects.

In the inductor component, preferably, the coil conductor layer contains sulfur in an amount of not greater than about 1 atm %. This configuration is less likely to adversely affect the properties, strength, and reliability of the inductor component.

Preferably, the inductor component further includes an outer electrode electrically connected to the coil conductor layer and exposed from the element body. Preferably, the outer electrode is not exposed from at least one of surfaces of the element body located at opposite ends in a lamination direction of the plurality of insulating layers. This configuration improves the Q value of the inductor component.

The inductor component, preferably, further includes another coil conductor layer winding on a main surface of another of the plurality of insulating layers. Preferably, the coil conductor layers are electrically connected in series and form a helical coil extending in the lamination direction of the plurality of insulating layers. With this configuration, a multilayer inductor component having a smaller size is obtained.

In the inductor component, preferably, the number of turns of the coil conductor layer on the main surface is less than one. This configuration allows the inner diameter of the coil conductor layer to be large, contributing to improvement in the inductance acquisition efficiency relative to the length of the coil conductor layer.

In the inductor component, preferably, the outer electrode includes an external conductor layer embedded in the element body. Preferably, the external conductor layer is exposed only from surfaces of the element body located at ends in a direction perpendicular to the lamination direction.

In this configuration, the magnetic flux passing through the radially inner side of the coil conductor layer is unlikely to be blocked by the external conductor layer. Furthermore, when the inductor component is mounted on the circuit board, the magnetic flux is substantially parallel to the main surface of the circuit board and is unlikely to be blocked by the circuit wiring on the circuit board. Thus, the Q value of the inductor component is improved.

In the inductor component, preferably, the element body has a substantially cuboidal shape, and the external conductor layer is exposed only from two of the surfaces of the element body located at ends in the direction perpendicular to the lamination direction. This configuration reduces the possibility that the magnetic flux passing through the outer side of the coil conductor layer is blocked by the external conductor layer. Thus, the Q value of the inductor component is improved.

According to one aspect of the present disclosure, internal defects are reduced.

Other features, elements, characteristics and advantages of the present disclosure will become more apparent from the following detailed description with reference to the attached drawings.

DETAILED DESCRIPTION

Hereinafter, one aspect of this disclosure is described as an embodiment.

In the attached drawings, some of the components are illustrated in magnified scale for ease of understanding. The dimension ratio of the components may be different from the actual dimensions or may differ from one figure to another.

Figure 1:
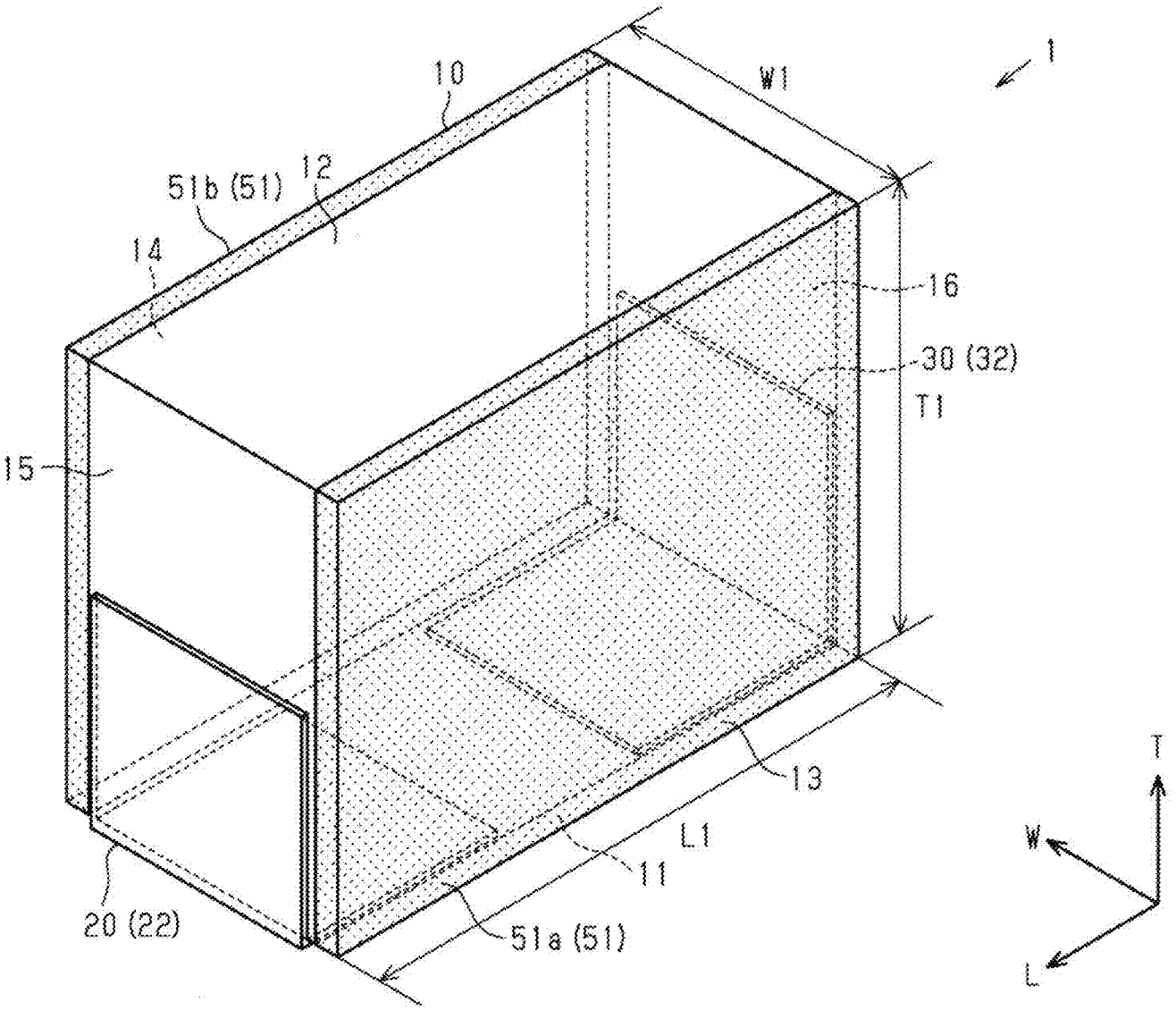
FIG. 1 is a schematic perspective view illustrating an external appearance of an inductor component.

As illustrated in FIG. 1, an inductor component 1 includes an element body 10. The element body 10 has a substantially cuboidal shape. Herein, the "cuboidal shape" includes a cuboidal shape having chamfered corners or chamfered edges and a cuboidal shape having rounded corners or rounded edge. In addition, the "cuboidal shape" may have a corrugated section, for example, over an entire or a portion of a main surface or a side surface. Opposing surfaces of the "cuboidal shape" may be imperfectly parallel to each other and may be slightly tilted with respect to each other.

The element body 10 has a mounting surface 11. The mounting surface 11 faces a circuit board when the inductor component 1 is mounted on the circuit board. The element body 10 has an upper surface 12 extending parallel to the mounting surface 11. The element body 10 further has two pairs of surfaces perpendicular to the mounting surface 11. One of the pairs includes a first side surface 13 and a second side surface 14. The other of the pairs includes a first end surface 15 and a second end surface 16.

Herein, a direction perpendicular to the upper surface 12 and the mounting surface 11 is referred to as a "height direction", a direction perpendicular to the first side surface 13 and the second side surface 14 is referred to as a "width direction", and a direction perpendicular to the first end surface 15 and the second end surface 16 is referred to as a "length direction". In FIG. 1, a "length direction L", a "height direction T", and a "width direction W" are indicated as specific examples. The dimension in the "width direction" is a "width", a dimension in the "height direction" is a "height", and a dimension in the "length direction" is a "length".

The element body 10 preferably has a size in the length direction L (length L1) of larger than 0 mm and not greater than about 1.0 mm (i.e., from larger than 0 mm to about 1.0 mm). For example, the length L1 is about 0.6 mm. The element body 10 preferably has a size in the width direction W (width W1) of larger than 0 mm and not greater than about 0.6 mm (i.e., from larger than 0 mm to about 0.6 mm). The width W1 is more preferably not greater than about 0.36 mm, and still more preferably not greater than about 0.33 mm. For example, the width W1 of the element body 10 is about 0.3 mm. The element body 10 preferably has a size in the height direction T (height T1) of larger than 0 mm and not greater than about 0.8 mm (i.e., from larger than 0 mm to about 0.8 mm). For example, the height T1 of the element body 10 is about 0.4 mm. In this embodiment, the height T1 of the element body 10 is larger than the width W1 (T1>W1).

Figure 2:
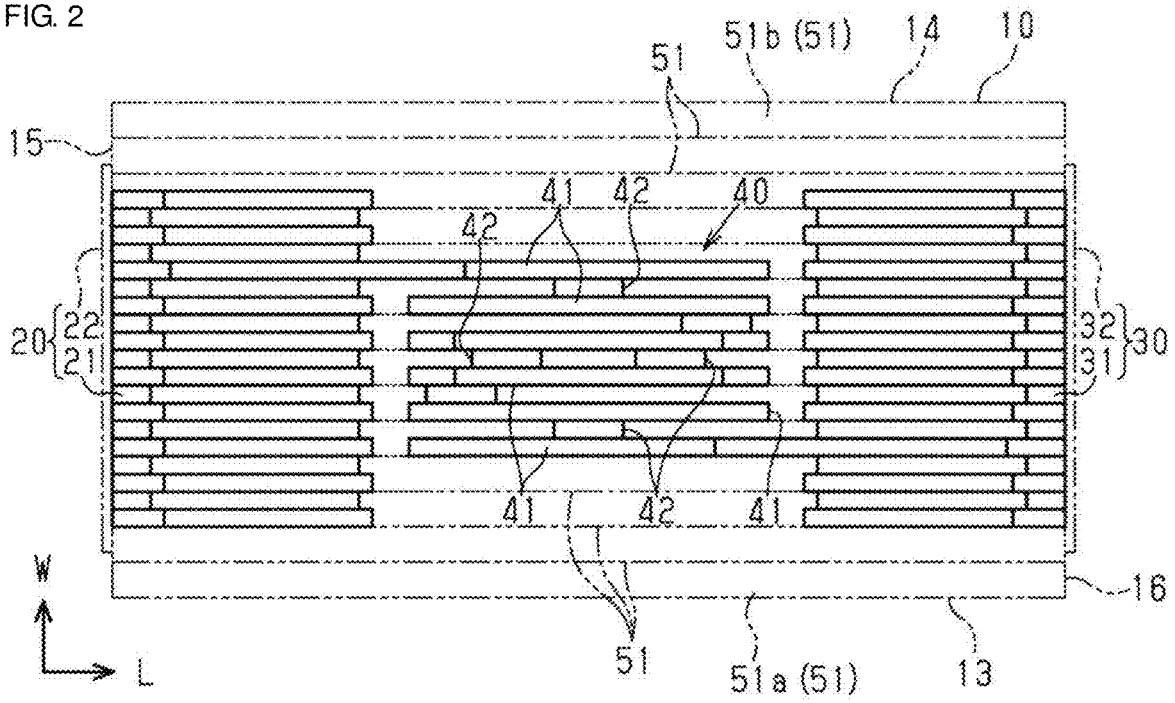
FIG. 2 is a schematic plan view illustrating a configuration of the inductor component.
Figure 3:
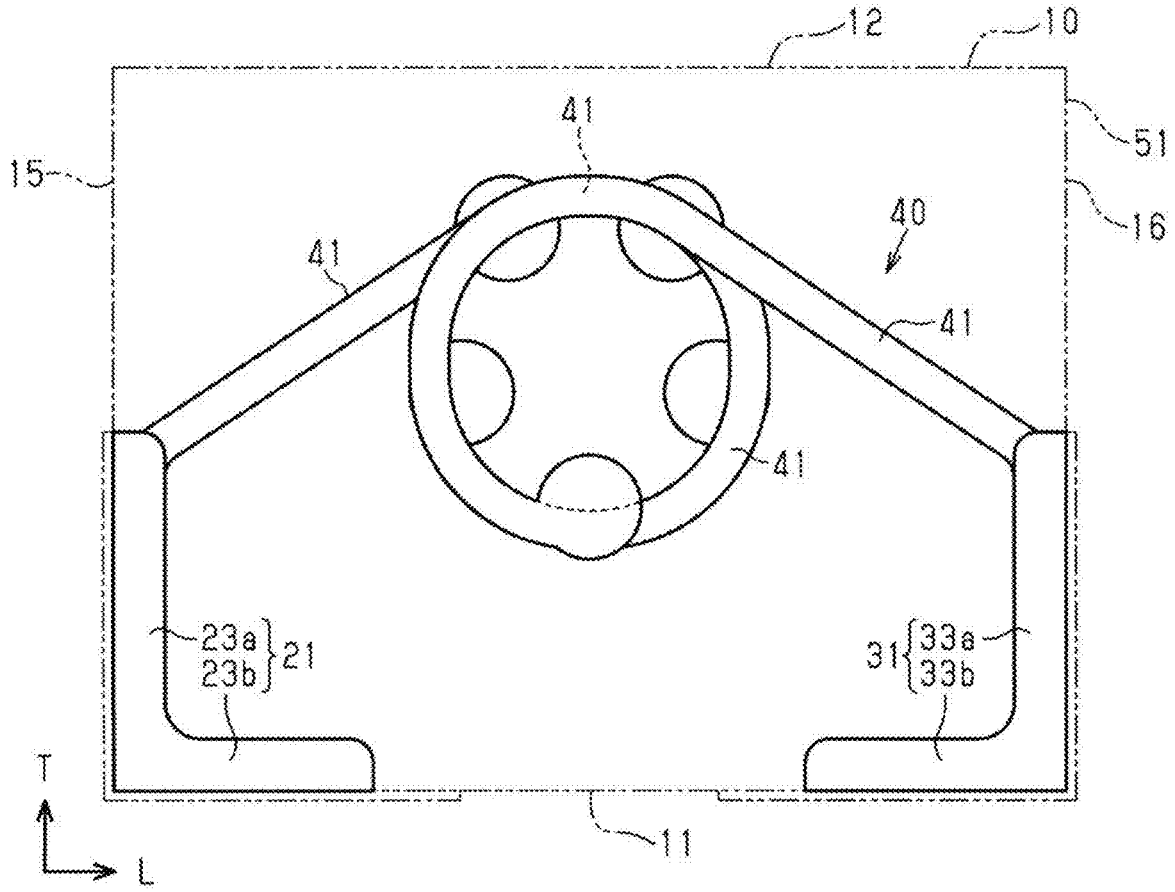
FIG. 3 is a schematic front view illustrating a configuration of the inductor component.

As illustrated in FIG. 2 and FIG. 3, the inductor component 1 includes a first outer electrode 20, a second outer electrode 30, and a coil 40. In FIG. 2 and FIG. 3, the coil 40 and external conductor layers 21 and 31 of the first and second outer electrodes 20 and 30, which are described later, are indicated by solid lines and the other components such as the element body 10 are indicated by two-dot chain lines for easy recognition of the coil 40 and the external conductor layers 21 and 31.

The first outer electrode 20 is exposed from the mounting surface 11 of the element body 10. The first outer electrode 20 is also exposed from the first end surface 15 of the element body 10.

In the same way, the second outer electrode 30 is exposed from the mounting surface 11 of the element body 10. The second outer electrode 30 is also exposed from the second end surface 16 of the element body 10.

In short, the first and second outer electrodes 20 and 30 are exposed from the mounting surface 11 of the element body 10. In other words, the surface of the element body 10 through which the first and second outer electrodes 20 and 30 are exposed is the mounting surface 11.

In this embodiment, the first outer electrode 20 includes an external conductor layer 21 and a cover layer 22. The external conductor layer 21 is embedded in the element body 10. The external conductor layer 21 has an L-like shape when viewed in the width direction W. The external conductor layer 21 includes an end surface electrode 23*a* exposed from the first end surface 15 of the element body 10 and a lower surface electrode 23*b* exposed from the mounting surface 11 of the element body 10. The end surface electrode 23*a* and the lower surface electrode 23*b* are integral along a ridge line of the first end surface 15 and the mounting surface 11. The cover layer 22 covers the external conductor layer 21 exposed from the first end surface 15 and the mounting surface 11 of the element body 10. Thus, the first outer electrode 20 is exposed only from the surfaces of the element body 10 located at ends in a direction perpendicular to the width direction W. Specifically described, the first outer electrode 20 is exposed only from the mounting surface 11 and the first end surface 15, i.e. two surfaces.

In this embodiment, the second outer electrode 30 includes an external conductor layer 31 and a cover layer 32. The external conductor layer 31 is embedded in the element body 10. The external conductor layer 31 has an L-like shape when viewed in the width direction W. The external conductor layer 31 includes an end surface electrode 33*a* exposed from the second end surface 16 of the element body 10 and a lower surface electrode 33*b* exposed from the mounting surface 11 of the element body 10. The end surface electrode 33*a* and the lower surface electrode 33*b* are integral along a ridge line of the second end surface 16 and the mounting surface 11. The cover layer 32 covers the external conductor layers 31 exposed from the second end surface 16 and the mounting surface 11 of the element body 10. Thus, the second outer electrode 30 is exposed only from the surfaces of the element body 10 located at the ends in the direction perpendicular to the width direction W. Specifically described, the second outer electrode 30 is exposed only from the mounting surface 11 and the second end surface 16, i.e., two surfaces.

In the above-described configuration, since the external conductor layers 21 and 31 are exposed only from the surfaces of the element body 10 located at the ends in the direction perpendicular to the width direction W, the magnetic flux passing through the inner hole of the coil conductor layer 41 is unlikely to be blocked by the external conductor layers 21 and 31. Furthermore, in the inductor component 1 mounted on a circuit board, the magnetic flux is parallel to the main surface of the circuit board and is unlikely to be blocked by the circuit wiring on the circuit board. Thus, the Q value of the inductor component 1 is improved.

In particular, the external conductor layers 21 and 31 are exposed only from the two surfaces of the element body 10 (the first end surface 15 and the mounting surface 11, the second end surface 16 and the mounting surface 11) located at the ends in the direction perpendicular to the width direction W. This reduces the possibility that the magnetic flux passing through the outer side of the coil conductor layer 41 is blocked by the external conductor layers 21 and 31. Thus, the Q value of the inductor component 1 is improved.

The cover layers 22 and 32 may be formed of a material having high solder resistance and high solder wettability. Examples of the material include metals such as nickel (Ni), copper (Cu), tin (Sn), and gold (Au) and alloys containing such metals. The cover layer may be composed of multiple layers. For example, the cover layer may include a nickel plate and a tin plate covering a surface of the nickel plate. The cover layers 22 and 32 may be eliminated. In such a case, the external conductor layer 21 is the first outer electrode 20, and the external conductor layer 31 is the second outer electrode 30.

The first outer electrode 20 on the first end surface 15 extends from the mounting surface 11 of the element body 10 to a substantially half of the height T1 of the element body 10. The first outer electrode 20 is positioned at substantially the center of the element body 10 in the width direction W. In this embodiment, the size (width) of the first outer electrode 20 in the width direction W is smaller than the width W1 of the element body 10. In other words, the first outer electrode 20 is not exposed from the first and second side surfaces 13 and 14 of the element body 10, which are located at opposite ends in the width direction W. The width of the first outer electrode 20 may be changed as necessary. For example, the first outer electrode 20 may extend over the entire width of the element body 10 in the width direction W. Alternatively, the first outer electrode 20 may be exposed from the mounting surface 11 but not through the first end surface 15 or vice versa.

The second outer electrode 30 on the second end surface 16 extends from the mounting surface 11 of the element body 10 to a substantially half of the height T1 of the element body 10. The second outer electrode 30 is positioned at substantially the center of the element body 10 in the width direction W. In this embodiment, the size (width) of the second outer electrode 30 in the width direction W is smaller than the width W1 of the element body 10. In other words, the second outer electrode 30 is not exposed from the first and second side surfaces 13 and 14 of the element body 10, which are located at opposite ends in the width direction W. The width of the second outer electrode 30 may be changed as necessary. For example, the second outer electrode 30 may extend over the entire width of the element body 10 in the width direction W. Alternatively, the second outer electrode 30 may be exposed from the mounting surface 11 but not through the second end surface 16 or vice versa.

As illustrated in FIG. 2, the element body 10 includes laminated multiple insulating layers 51. A boundary between the insulating layers 51 is not clear in some cases.

The insulating layers 51 each have an oblong planar shape. The element body 10 has a substantially cuboidal shape defined by the insulating layers 51 laminated on one another. The insulating layer 51 is a sintered body formed of a magnetic material such as ferrite or a non-magnetic material, such as glass and alumina, for example. The insulating layer 51 is not limited to the sintered body and may be formed of an insulating material that is not melt at a low temperature. Insulating layers 51*a* and 51*b* of the insulating layers 51, which constitute the first and second side surfaces 13 and 14, have a color different from that of the other insulating layers 51 located between the insulating layers 51*a* and 51*b*.

As illustrated in FIG. 2 and FIG. 3, the coil 40 is embedded in the element body 10. The coil 40 is connected to the first outer electrode 20 at the first end and connected to the second outer electrode 30 at the second end. The coil 40 includes coil conductor layers 41 winding on the main surfaces of the insulating layers 51 and via conductor layers 42 connecting the coil conductor layers 41 to each other.

The number of turns of each of the coil conductor layers 41 on the main surface of the insulating layer 51 is less than one. The coil conductor layers 41 each extend in substantially circle while partly overlapping each other when viewed in the width direction W (a direction perpendicular to the first side surface 13 and the second side surface 14 in FIG. 1 and a lamination direction of the insulating layers 51 in which the insulating layers 51 are laminated). Furthermore, since the coil conductor layers 41 adjacent to each other in the width direction W are connected to each other at the end portions via the via conductor layers 42, the coil conductor layers 41 are electrically connected in series. This forms the helical coil 40 extending in the width direction W. The coil 40 has a substantially circular shape when viewed in the width direction W. The phrase "overlap each other" includes slightly away from each other due to production variation, for example. The shape of the coil 40 is not limited to the above-described shape. The coil 40 may extend in other shapes, such as an ellipse, a rectangle, other polygonal shapes, and combinations of the above-described shapes, when viewed in the width direction W.

The outermost coil conductor layers 41 in the width direction each have an extension extending from the circle and connected to the outer electrode 20 or 30 (the external conductor layers 21 or 31). Thus, the outer electrodes 20 and 30 are electrically connected to the coil conductor layers 41. As described later, the outermost coil conductor layers 41 in the width direction W and the external conductor layers 21 and 31 connected to the outermost coil conductor layers 41 are integrally formed as an integral component.

The coil 40 (the coil conductor layers 41 and the via conductor layers 42) may be formed of a conducting material containing silver (Ag) as a main component and sulfur (S), for example. For example, the material of the coil 40 may contain silver (Ag), sulfur (S), silicon (Si), and zirconium (Zr). The content of sulfur is preferably not greater than about 1 atm %, for example. The contents of Ag, S, Si, and Zr are, respectively, about 97.5, about 0.5, about 1.3, and about 0.7 (atm %), for example. The coil 40 may be formed of metal having relatively small electrical resistance, such as copper and gold, or a conducting material containing an alloy of such metals as a main component, for example. Any metal material that undergoes necking at a lower temperature than the material of the insulating layers 51 may be employed.

(Production Method)

Next, a method of producing the inductor component 1 is briefly described.

First, a mother insulator layer is formed. The mother insulator layer includes portions to be the element bodies 10 in continuous rows and columns. Specifically described, an insulating paste containing borosilicate glass as a main component is applied onto a polyethylene terephthalate (PET) film by screen printing to form an insulating sheet (a green sheet). A plurality of such sheets is prepared.

Then, through holes are formed in the insulating sheet by laser, for example, at portions where the external conductor layers 21 and 31 and the via conductor layers 42 are to be formed. A conductive paste including a conductive material used in the coil 40 is applied by screen printing into the through holes and onto portions of the main surfaces of the insulating sheets where the external conductor layers 21 and 31, the coil conductor layers 41, and the via conductor layers 42 are to be formed. A predetermined number of the insulating sheets having the conductive paste thereon and a predetermined number of insulating sheets not having the conductive paste thereon are laminated on one another and fixed by application of pressure to form the mother insulator layer.

Then, the mother insulator layer is cut with a dicing machine or a guillotine cutter, for example, into pieces of insulator layers to be the element bodies 10. The pieces of the insulator layers are fired in a furnace, for example, to form the element bodies 10 having the external conductor layers 21 and 31, the coil conductor layers 41, and the via conductor layers 42 therein. The pieces of the insulator layers have a larger size than the element bodies 10, since the insulator layers may be shrink when fired.

Then, the corners of the element body 10 are chamfered by barrel finishing. In this process, nickel, copper, and tin are applied in this order by barrel plating onto the surfaces of the external conductor layers 21 and 31 to form the cover layers 22 and 32. Thus, the outer electrodes 20 and 30 are formed, and the inductor component 1 is obtained.

(Operations)

The inductor component 1 includes the element body 10 including the insulating layers 51 laminated on one another and the coil conductor layers 41 winding on the main surfaces of the insulating layers 51. The coil conductor layer 41 contains sulfur. Hereinafter, the operations of this configuration are described.

Figure 6A:
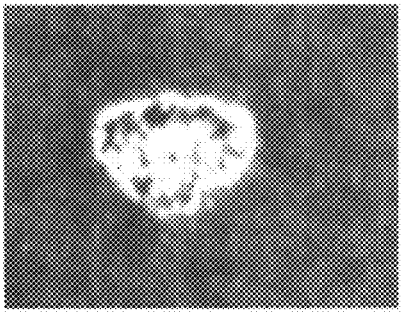
FIGS. 6A and 6B are photographs of a cross-section of a coil conductor layer.
Figure 6B:
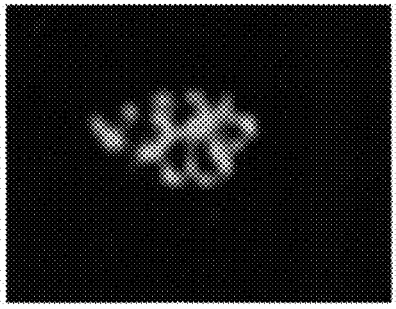

FIG. 6A illustrates the cross-section of the coil conductor layer 41 including sulfur. FIG. 6B is a result of mapping of sulfur obtained through analysis of the components of the conductor layer 41 (WDX analysis).

In the firing of the inductor component 1, the insulating pastes to be the insulating layers 51 and the conductive pastes to be the coil conductor layers 41 are different in the volume change. Thus, the insulator layers to be the element body 10 is internally stressed a lot during firing. The internal stress may cause an internal defect such as delamination and cracking in the element body 10 that has been fired. To solve the problem, the inventor of this application has conceived an idea of using the coil conductor layer 41 containing sulfur.

Figure 5:
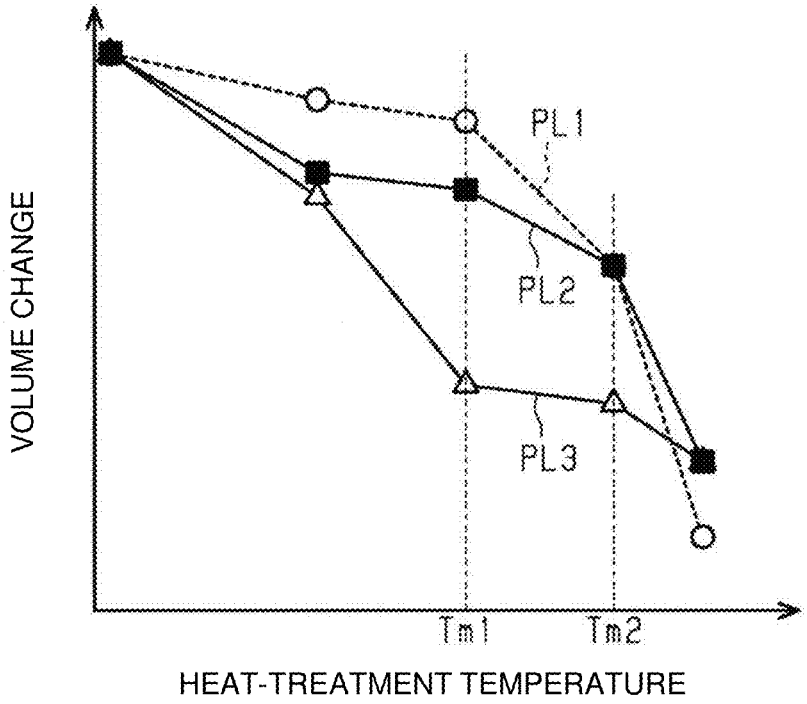
FIG. 5 is a diagram indicating heat-treatment temperatures and volume changes.

FIG. 5 indicates volume changes of a conductive paste containing sulfur and a conductive paste not containing sulfur with the progress of firing. In FIG. 5, a broken line PL1 indicates a volume change of an insulating paste. A solid line PL2 indicates a volume change of a conductive paste containing sulfur. A solid line PL3 indicates a volume change of a conductive paste not containing sulfur.

As indicated in FIG. 5, around a temperature Tm1 where the firing has progressed to some degrees, the volume change PL3 of the conductive paste not containing sulfur is distant from the volume change PL1 of the insulating paste. In contrast, the volume change PL2 of the conductive paste containing sulfur is not distant from the volume change PL1 of the insulating paste. In particular, around the temperature Tm2 where the firing has progressed more, the volume change PL3 of the conductive paste not containing sulfur is still distant from the volume change PL1 of the insulating paste, but the volume change PL2 of the conductive paste containing sulfur is substantially equal to the volume change of the insulating paste.

Next, it was determined as below if the gap between the volume change PL1 of the insulating paste and the volume change PL2 or PL3 of the conductive paste during firing causes the internal defect, such as delamination and cracking.

First, thirty samples of the inductor components 1 including the coil conductor layers 41 containing sulfur and thirty samples of the inductor components including the coil conductor layers not containing sulfur were prepared. The number of internal defects in the samples was checked. In the defect checking, the cross-section of the sample was polished and observed by using an SEM to determine whether the cross-section has a void (internal defect). If the cross-section has a void, the size of the void was determined. In this defect checking, a scratch (polishing flaw) made in the polishing may be an obstacle in the checking of the internal defects. Thus, voids having a size of about 10 μm or more are determined as the internal defects to eliminate the polishing flaw.

In the samples including the coil conductor layers not containing sulfur, the occurrence of the internal defect was 100%. In other words, every sample had the internal defect. The maximum size of the observed void (internal defect) was about 29.0 μm. In contrast, in the samples including the coil conductor layers 41 containing sulfur, the occurrence of the internal defect was 0%. In other words, every sample did not have the internal defect. The sizes of the observed voids were not greater than about 5 μm. The results show that the internal defects are reduced in the inductor component 1 including the coil conductor layers 41 containing sulfur.

As described above, the inventors of the present application found that the employment of the coil conductor layer 41 containing sulfur does not allow the volume change of the conductive paste during firing to be distant from the volume change of the insulating paste, leading to less internal defects in the inductor component.

Figure 4:
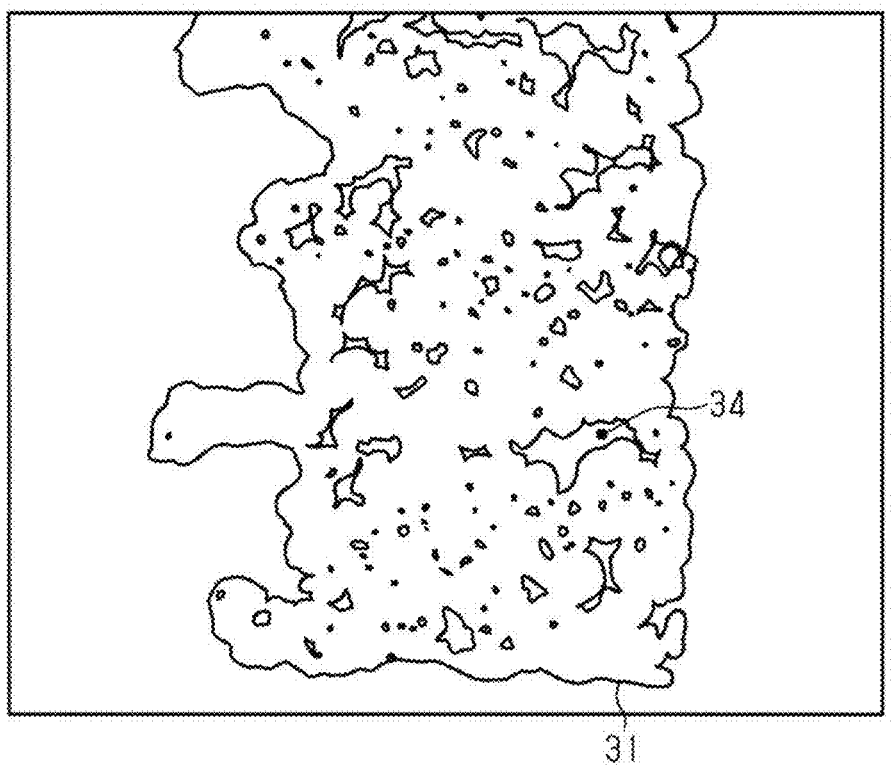
FIG. 4 is a schematic view illustrating a photograph of a cross-section of the coil conductor layer.

The content of sulfur in the coil conductor layer 41 is preferably not greater than about 1 atm %. FIG. 4 is a schematic view illustrating a photograph of the cross-section of the coil conductor layer 41 having the sulfur content of larger than about 1 atm %. As indicated in FIG. 4, when the content of sulfur (S) is too high, the coil conductor layer 41 has many voids 34 and is not dense. In this case, although the internal defects possibly caused between the insulating layers 51 and the coil conductor layers 41 are reduced, the voids 34 may adversely affect the properties, strength, and reliability of the inductor component 1.

As described above, the employment of the coil conductor layer 41 containing sulfur reduces the internal stress in the element body 10. This allows the coil conductor layer 41 to have a larger size. For example, in this embodiment, the thickness of the coil conductor layer 41 is able to be made larger in the width direction W (the lamination direction of the insulating layers 51). In such a case, the cross-sectional area of the coil conductor layer 41 is made large while the inner diameter of the coil conductor layer 41 being fixed. Thus, the Q value of the inductor component 1 is increased.

Furthermore, in this embodiment, the outer electrodes 20 and 30 are not disposed on the first and second side surfaces 13 and 14 of the element body 10, which are located at opposite ends in the width direction W. In this case, the land size of the inductor component 1 on the circuit board does not exceed the width W1 of the inductor component 1. Specifically described, this allows the width W1 to increase to the edge of the space of the circuit board for the inductor component 1, or this allows the thickness of the coil conductor layer 41 to increase in the width direction W. Thus, the cross-sectional area of the coil conductor layer 41 is made large while the inner diameter of the coil conductor layer 41 being fixed. Thus, the Q value of the inductor component 1 is increased.

As described above, according to the embodiment, the advantages below can be achieved.

(1) The inductor component 1 includes the element body 10 including the insulating layers 51 laminated on one another and the coil conductor layers 41 winding on the main surfaces of the insulating layers 51. The coil conductor layers 41 contain sulfur. This configuration reduces internal defects.

(2) The coil conductor layers 41 containing sulfur improve the Q value of the inductor component 1.

(3) The inductor component 1 further includes the outer electrodes 20 and 30 electrically connected to the coil conductor layers 41 and exposed from the element body 10. The outer electrodes 20 and 30 are not exposed from at least one of the surfaces (the first and second side surfaces 13 and 14) of the element body 10 located at opposite ends in the lamination direction (the width direction W) of the insulating layers 51. This configuration improves the Q value of the inductor component 1.

(4) the coil conductor layers 41 contain sulfur in an amount of not greater than about 1 atm %. This configuration suppresses the decrease in sinterability and is less likely to adversely affect the properties, strength, and reliability of the inductor component 1.

The embodiment may be modified as below. The attached drawings merely illustrate one example of the inductor component 1 according to the embodiment. The shape, the number of layers, and other configurations may be modified as necessary.

In the inductor component 1, the outer electrodes 20 and 30 include the external conductor layers 21 and 31 embedded in the element body 10. However, the outer electrodes 20 and 30 may have a different configuration. For example, the extension of the coil conductor layer 41 may be exposed from the first and second end surfaces 15 and 16. A conductive paste may be applied to the entire of the first and second end surface 15 and 16 including the exposed portions by a dipping method. Then, the element body 10 may be baked to form baked electrodes. The baked electrodes may be formed not only on the first and second end surface 15 and 16 but also on the mounting surface 11, the upper surface 12, the first side surface 13, and the second side surface 14 to provide a "five-surface electrode structure".

As an example of a method of producing the inductor component 1, a sheet lamination method is described. However, the inductor component 1 may be produced by a different method. For example, a print lamination method and other known method may be employed. The contents of the disclosure are essentially applicable to any inductor components including fired coil conductor layers and are not restricted by the production method.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. An inductor component comprising:

an element body including a plurality of insulating layers laminated on one another;

a coil conductor layer winding on a main surface of one of the plurality of insulating layers; and a via layer which is connected to the coil conductor layer, wherein the coil conductor layer contains silver or copper as a main component and sulfur, the coil conductor layer has a linear shape, and the via layer includes sulfur.

2. The inductor component according to claim 1, wherein the coil conductor layer contains sulfur in an amount of not greater than about 1 mol %.

3. The inductor component according to claim 1, further comprising:

an outer electrode electrically connected to the coil conductor layer and exposed from the element body, wherein the outer electrode is not exposed from at least one of surfaces of the element body located at opposite ends in a lamination direction of the plurality of insulating layers.

4. The inductor component according to claim 1, further comprising:

another coil conductor layer winding on a main surface of another of the plurality of insulating layers, wherein the coil conductor layers are electrically connected in series and form a helical coil extending in the lamination direction of the plurality of insulating layers.

5. The inductor component according to claim 1, wherein the number of turns of the coil conductor layer on the main surface is less than one.

6. The inductor component according to claim 3, wherein the outer electrode includes an external conductor layer embedded in the element body, and the external conductor layer is exposed only from surfaces of the element body located at ends in a direction perpendicular to the lamination direction.

7. The inductor component according to claim 6, wherein the element body has a substantially cuboidal shape, and the external conductor layer is exposed only from two of the surfaces of the element body located at ends in the direction perpendicular to the lamination direction.

8. The inductor component according to claim 2, further comprising:

an outer electrode electrically connected to the coil conductor layer and exposed from the element body, wherein the outer electrode is not exposed from at least one of surfaces of the element body located at opposite ends in a lamination direction of the plurality of insulating layers.

9. The inductor component according to claim 2, further comprising:

another coil conductor layer winding on a main surface of another of the plurality of insulating layers, wherein the coil conductor layers are electrically connected in series and form a helical coil extending in the lamination direction of the plurality of insulating layers.

10. The inductor component according to claim 3, further comprising:

another coil conductor layer winding on a main surface of another of the plurality of insulating layers, wherein the coil conductor layers are electrically connected in series and form a helical coil extending in the lamination direction of the plurality of insulating layers.

11. The inductor component according to claim 8, further comprising:

another coil conductor layer winding on a main surface of another of the plurality of insulating layers, wherein the coil conductor layers are electrically connected in series and form a helical coil extending in the lamination direction of the plurality of insulating layers.

12. The inductor component according to claim 2, wherein the number of turns of the coil conductor layer on the main surface is less than one.

13. The inductor component according to claim 3, wherein the number of turns of the coil conductor layer on the main surface is less than one.

14. The inductor component according to claim 4, wherein the number of turns of the coil conductor layer on the main surface is less than one.

15. The inductor component according to claim 8, wherein the number of turns of the coil conductor layer on the main surface is less than one.

16. The inductor component according to claim 9, wherein the number of turns of the coil conductor layer on the main surface is less than one.

17. The inductor component according to claim 10, wherein the number of turns of the coil conductor layer on the main surface is less than one.

18. The inductor component according to claim 11, wherein the number of turns of the coil conductor layer on the main surface is less than one.

19. The inductor component according to claim 8, wherein the outer electrode includes an external conductor layer embedded in the element body, and the external conductor layer is exposed only from surfaces of the element body located at ends in a direction perpendicular to the lamination direction.

20. The inductor component according to claim 19, wherein the element body has a substantially cuboidal shape, and the external conductor layer is exposed only from two of the surfaces of the element body located at ends in the direction perpendicular to the lamination direction.

* * * * *